United States Patent [19]

Takamuki et al.

[11] Patent Number: 5,030,546

[45] Date of Patent: Jul. 9, 1991

[54] PROCESSING METHOD OF LIGHT-SENSITIVE SILVER HALIDE PHOTOGRAPHIC MATERIAL

[75] Inventors: Yasuhiko Takamuki; Takeo Arai, both of Hino, Japan

[73] Assignee: Konica Corporation, Tokyo, Japan

[21] Appl. No.: 402,799

[22] Filed: Sep. 5, 1989

[30] Foreign Application Priority Data

Sep. 7, 1988 [JP] Japan ..... 63-224003

[51] Int. Cl.[5] ..... G03C 1/06

[52] U.S. Cl. ..... 430/264; 430/963

[58] Field of Search ..... 430/264, 963

[56] References Cited

U.S. PATENT DOCUMENTS 4,761,362 8/1988 Sasaoka et al. ..... 430/267
4,766,058 8/1988 Sampei et al. ..... 430/496
4,786,587 11/1988 Kuwabara ..... 430/566
4,865,947 9/1989 Kuwabara et al. ..... 430/264

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

There is disclosed a processing method of a light-sensitive silver halide photographic material to be used in a method for forming an image be developing and fixing a negative type light-sensitive silver halide photographic material having at least one layer of light-sensitive silver halide emulsion layer on a support, which comprises the silver density on the emulsion layer side of said light-sensitive silver halide photographic material is 0.5 g/cm$^2$ or higher and also a hydrazine derivative is contained in said layer, and the light-sensitive silver halide photographic material is processed within a developing time of 15 seconds.

8 Claims, No Drawings

PROCESSING METHOD OF LIGHT-SENSITIVE SILVER HALIDE PHOTOGRAPHIC MATERIAL

BACKGROUND OF THE INVENTION

This invention relates to a processing method of a light-sensitive silver halide photographic material, particularly to a processing method of a light-sensitive silver halide photographic material which is suitable for rapid developing and also high contrast.

In recent years, in the field of making printing photographic plates, color formation and complication of printed matters are under rapid progress. For this reason, demands for improvement of quality and stability of quality are increasing year by year for light-sensitive silver halide photographic materials for printing (hereinafter referred to "printing material") which are intermediate media of printing. In the prior art, processing aptitude for the so-called "lith development" has been imparted to general printing sensitive materials for accomplishing high quality. However, in the "lith development", it is impossible in mechanism to contain sulfite ion which is the preservative at high concentration in the development processing solution, and therefore stability of the developer is very poor, as is well known to those skilled in the art.

As the technique for cancelling instability of "lith development" and also obtaining high contrast image comparable to "lith development" processing, migration to the so-called rapid access developing method can be seen. In this case, for improving contrast, examples of processing light-sensitive materials containing a compound such as tetrazolium with PQ type or MQ type developer containing relatively higher concentrations of sulfites are disclosed in, for example, Japanese Provisional Patent Publications No. 18317/1977, No. 177193/1978, No. 17720/1978, etc. Similarly, as disclosed in Japanese Provisional Patent Publications No. 16623/1978, No. 20921/1978, No. 20922/1978, No. 49429/1978, No. 66731/1978, No. 66732/1978, No. 77616/1978, No. 84714/1978, No. 137133/1978, No. 37732/1979, No. 40629/1979, No. 52050/1980, No. 90940/1980, No. 67843/1981, there have been known the methods to obtain ultra-high contrast negative images by processing a surface latent image type light-sensitive silver halide photographic material containing a hydrazine derivative, particularly a specific acylhydrazine compound added therein with a solution containing 0.15 mole/1 or more of a sulphurous acid preservative at pH 11.0 to 12.3. According to these methods, it has become possible to obtain a hard tone image even by rapid treatment of developing time of 20 seconds to 30 seconds. However, to cope with the increasing information in recent years, the need to deal with the matters within shorter time and yet in larger amount is increasing even for the field of printing, and also the developing time is demanded to be 20 seconds or shorter.

Shortening of developing time will bring about lowering in image density as a matter of course, which may also cause deterioration of image and lowering in sensitivity. Thus, under the present situation, it is very highly required to have a light-sensitive material and processing method which can maintain hard tone and will not cause deterioration of performance by ultra-high speed processing.

SUMMARY OF THE INVENTION

To cope with the problems as described above, an object of the present invention is to provide a light-sensitive silver halide photographic material and a processing method therefor which can obtain high sensitivity and high contrast image even by ultra-high speed development, namely by developing processing within 15 seconds.

The above object of the present invention is accomplished by a processing method of a light-sensitive silver halide photographic material to be used in a method for forming an image by developing and fixing a negative type light-sensitive silver halide photographic material having at least one layer of light-sensitive silver halide emulsion layer on a support, wherein the silver density on the emulsion layer side of said light-sensitive silver halide photographic material is 0.5 g/cm$^3$ or higher and also a hydrazine derivative is contained in said layer, and said light-sensitive silver halide photographic material is processed within a developing time of 15 seconds.

DESCRIPTION OF THE PREFERRED EMBODIMENTS

The silver density in the present invention means the silver amount per unit volume, and can be determined specifically as described below. When the film thickness value of the whole hydrophilic colloidal layer on the side containing the light-sensitive emulsion layer formed by coating and drying on a support at a temperature of 23° C. and a relative humidity of 55 % is defined as h cm and the attached amount of the emulsion coated per unit area as calculated only on silver as A g/cm$^3$, the silver density G is represented by:

$$G = A/h \ g/cm^3.$$

In the present invention, the silver density is preferably 0.5 to 5 g/cm$^3$, more preferably 0.5 to 3 g/cm$^3$, particularly preferably 0.5 to 1.5 g/cm$^3$.

Next, as the contrast increasing agent preferably used in the present invention, there may be included the hydrazine compounds represented by the formulae (1) and (2) shown below.

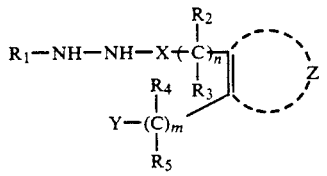

(1)

[wherein $R_1$ represents a heterocyclic residue having at least one of an oxygen atom, a nitrogen atom or a sulfur atom; $R_2$ to $R_5$ each represent a hydrogen atom, an alkyl group having 1 to 18 carbon atoms or an aryl group; n and m each represent 0 or 1; X represents a carbonyl group, a sulfonyl group, a sulfoxy group,

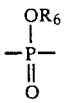

($R_6$ represents the same meaning as $R_2$ to $R_5$), an imino group; Y represents a hydroxyl group, an amino group, a carboxyl group, a mercapto group; Z represents atoms necessary for forming a 5- to 6-membered ring].

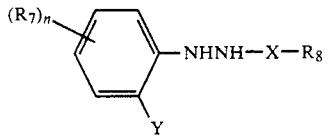

(2)

[wherein $R_7$ represents a monovalent substituent substitutable on the benzene ring; n represents 0 to 4, and when n is 2 or more, $R_7$'s may be either the same or different; $R_8$ represents a hydrogen atom, a substituted or unsubstituted alkyl group, a substituted or unsubstituted aryl group, a substituted or unsubstituted heterocyclic group; X represents a carbonyl group, a sulfonyl group, a sulfoxy group,

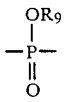

($R_9$ represents the same meaning as $R_8$), a N-substituted or unsubstituted imino group; and Y represents hydrogen atom, a hydroxyl group, an amino group, a carboxyl group or a mercapto group].

Further, the above formula (1) is to be described in detail.

Specific examples of $R_1$ may include thienyl, furyl, pyrrolyl, pyrazolyl, imidazolyl, pyridyl, pyrimidinyl, pyrazinyl, benzothienyl, benzofuranyl, indolyl, indazolyl, benzoxazolyl, oxazolyl, thiazolyl, etc., preferably thienyl, furyl, pyrrolyl, pyrazolyl, etc.

$R_2$ to $R_5$ may be either the same or different, and represent a hydrogen atom, an alkyl group having 1 to 18 carbon atoms (a methyl group, an ethyl group, a propyl group, a butyl group, an octyl group, a dodecyl group, an octadecyl group and others), or an aryl group (e.g. a phenyl group).

n and m each represent 0 or 1.

X represents a carbonyl group, a sulfonyl group, a sulfoxy group,

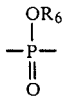

or a substituted or unsubstituted imino group (an imino group, an N-methylimino group, an N-phenylimino group), preferably a carbonyl group.

Y represents a hydroxyl group, a substituted or unsubstituted amino group (an amino group, a methylamino group, an anilino group, etc.), a carboxy group, a mercapto group, preferably a hydroxyl group.

Z represents atoms necessary for forming a 5- to 6-membered ring, and specific rings to be formed may include benzene, cyclohexene, cyclopentene, etc., preferably benzene.

Various substituents can be introduced into the heterocyclic group having at least one of nitrogen atom, sulfur atom or oxygen atom represented by $R_1$. Examples of substituents which can be introduced may include a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamide group, an arylaminothiocarbonylamino group, a hydroxy group, a carboxy group, a sulfo group, a nitro group, a cyano group, etc.

The compound represented by the formula (1) preferably contains at least one of diffusion resistant groups or silver halide adsorption promoting grcups within the molecule.

As the diffusion resistant group, ballast groups conventionally used in the immobilizing additive for photography such as coupler, etc. are preferred. Ballast groups are relatively inert groups to photographic characteristic and having 8 or more carbon atoms, which can be selected from, for example, alkyl, alkoxy, phenyl, alkylphenyl, phenoxy, alkylphenoxy groups, etc.

As the silver halide adsorption promoting group, there may be included the groups as disclosed in U.S. Pat. No. 4,385,108 such as a thiourea group, a thiourethane group, a heterocyclic thioamide group, a mercapto heterocyclic group, a triazole group, etc.

The H in —NHNH— in the formula (1), namely the hydrogen atom of hydrazine may be substituted with a substituent such as sulfonyl group (e.g. methanesulfonyl, toluenesulfonyl, etc.), an acyl group (e.g. acetyl, trifluorocetyl, etc.), an oxalyl group (e.g. ethoxalyl, etc.), and the compounds represented by the formula (1) also include such compounds.

Representative compounds represented by the above formula (1) may include those as shown below. As a matter of course, the specific compounds of the formula (1) useful in the present invention are not limited to these compounds.

Exemplary compounds:

(1)-1

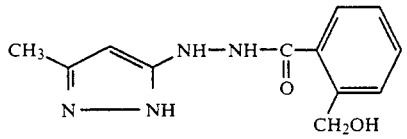

(1)-2

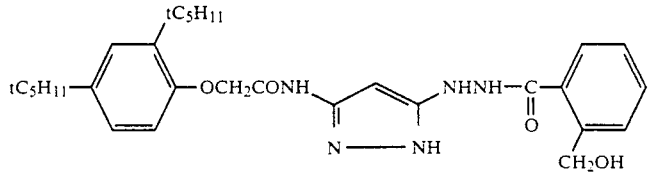

-continued
(1)-3
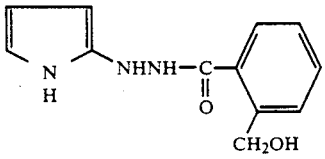
(1)-4
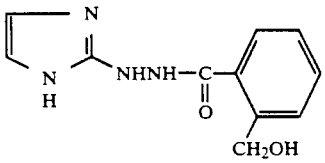
(1)-5
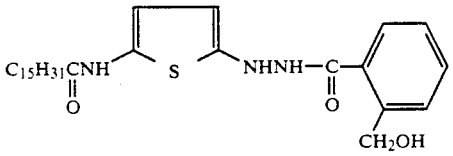
(1)-6
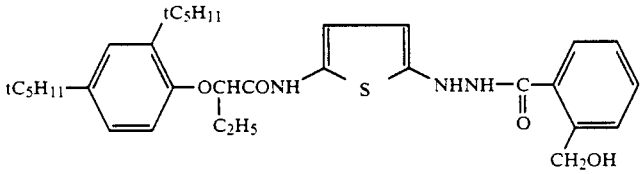
(1)-7
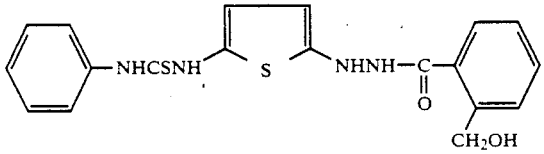
(1)-8
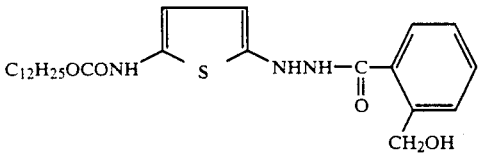
(1)-9
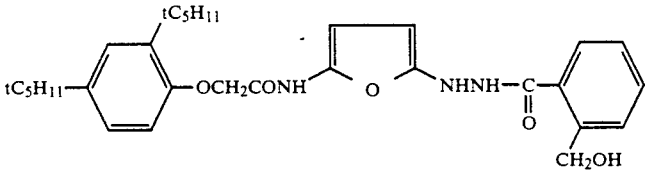
(1)-10
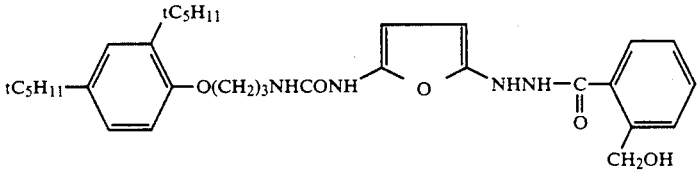
(1)-11
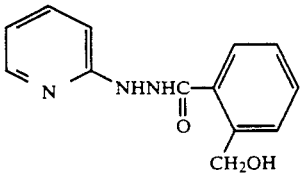

-continued
(1)-12
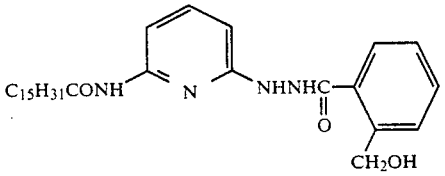
(1)-13
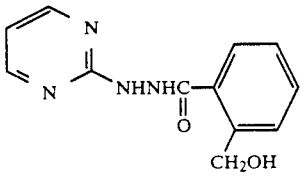
(1)-14
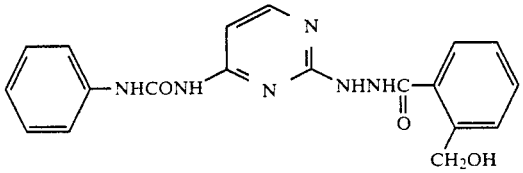
(1)-15
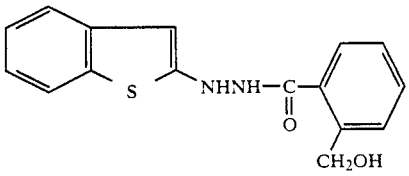
(1)-16
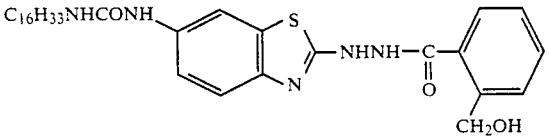
(1)-17
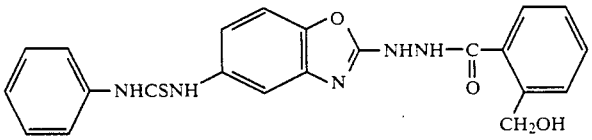
(1)-18
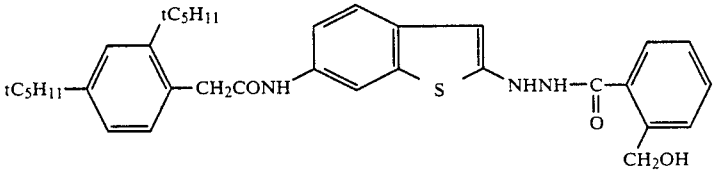
(1)-19
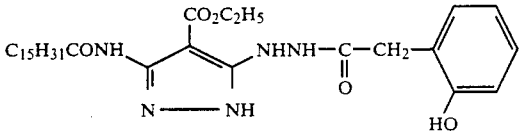
(1)-20
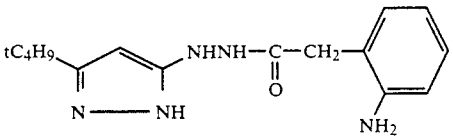

-continued
(1)-21
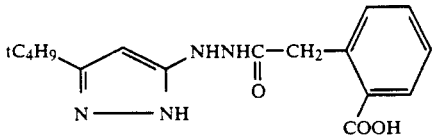
(1)-22
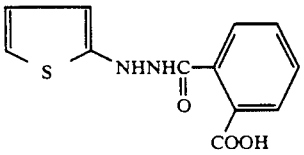
(1)-23
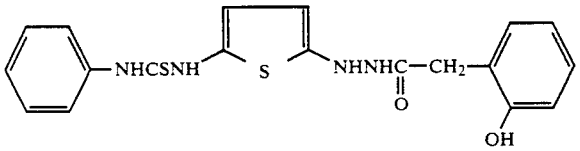
(1)-24
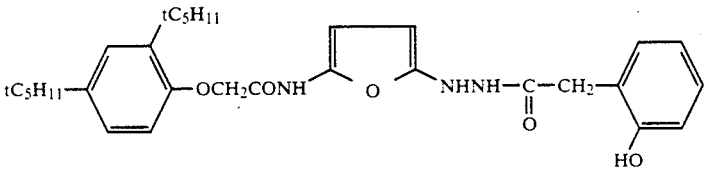
(1)-25
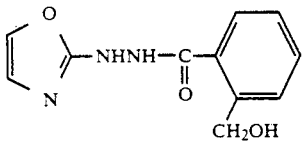
(1)-26
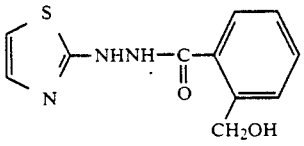
(1)-27
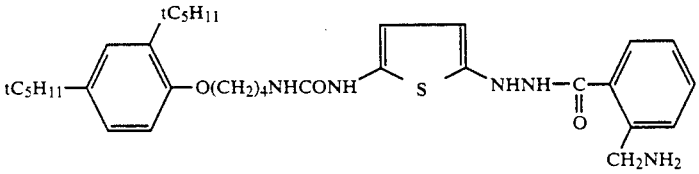
(1)-28
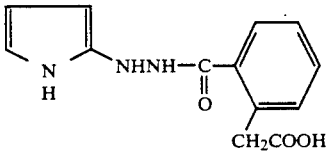
(1)-29
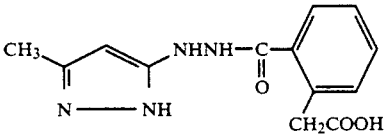
(1)-30
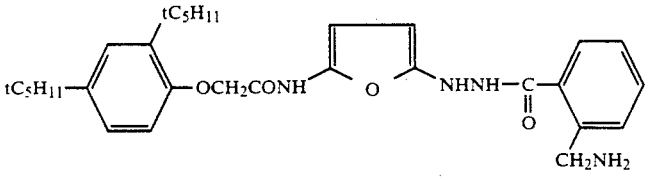

-continued (1)-31

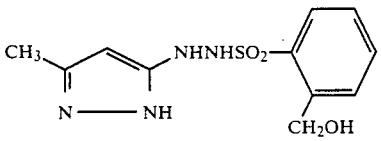

(1)-32

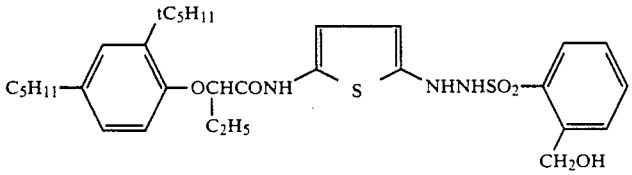

(1)-33

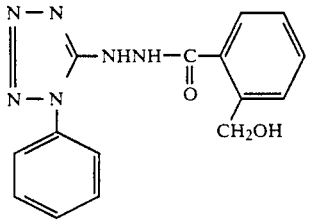

(1)-34

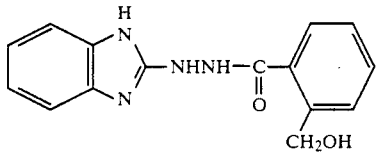

In the following, synthesis examples of the specific compounds of the present invention are described.

Concerning the photosensitive compounds (1)-6, its synthesis scheme is as follows.

The starting material 5-nitro-2-thienylhydrazine can be synthesized according to the method of, for example:

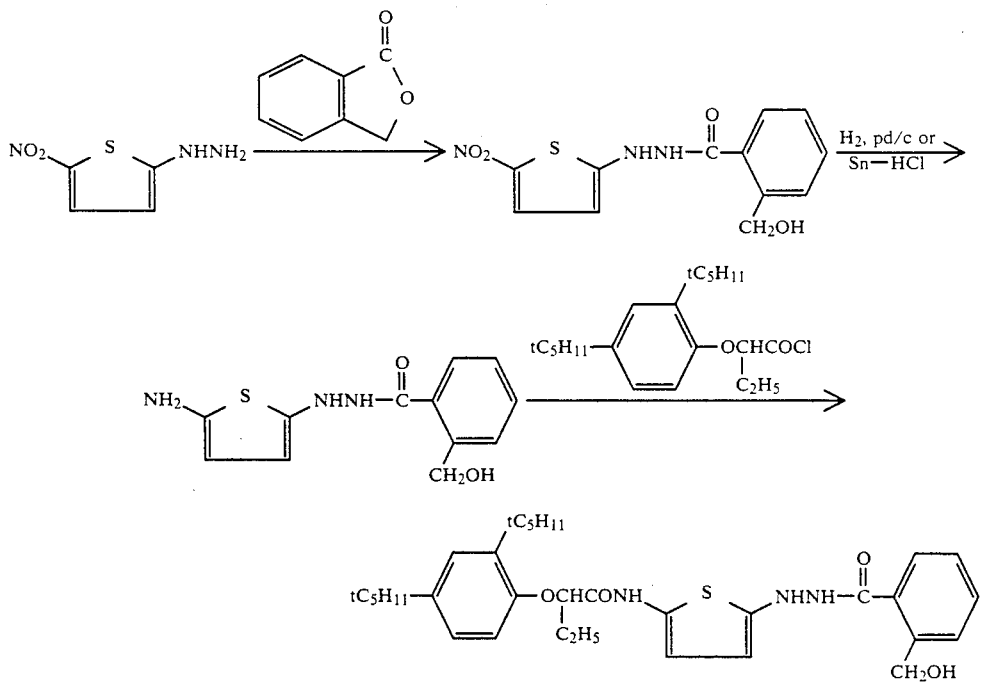

This synthetic method can be practiced by referring to, for example, the synthetic method of Japanese Provisional Patent No. 29751/1988.

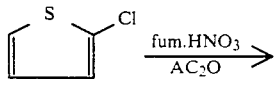

-continued

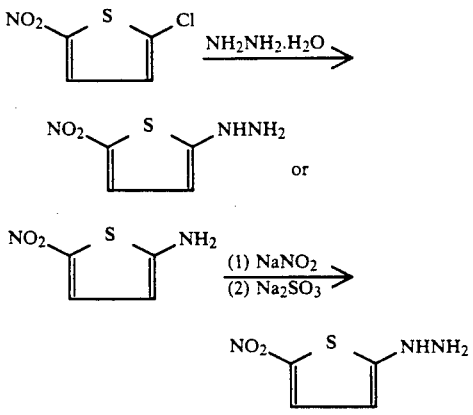

The synthetic method of 3-nitro-2-thienylhydrazine is described in "Journal fur Praktische Chemie", vol. 24, pp. 91 to 99 (1964), which synthetic method can be also incorporated by way of reference.

On the other hand, 5-nitro-2-furylhydrazine which is the starting material for the compound of the present invention (1)-6 is described in "Anales de la Real Academie de Farmacia", vol. 27, No. 1, pp. 47 to 60 (1961).

By referring to these literatures, other compounds can be also synthesized similarly.

In the light-sensitive silver halide photographic material of the present invention, the compound represented by the above formula (1) is contained, and the amount of the compound of the formula (1) contained in the light-sensitive photographic material of the present invention may be preferably $5 \times 10^{-7}$ mole to $5 \times 10^{31}$ 1 mole per mole of silver halide contained in the light-sensitive photographic material of the present invention.

Particularly, it is preferred that the amount may be within the range of from $5 \times 10^{-5}$ mole to $1 \times 10^{-2}$ mole.

Further, the above formula (2) is to be described in detail.

As the monovalent substituent represented by $R_7$, there may be included, for example, a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamide group, an arylaminothiocarbonylamino group, a hydroxy group, a carboxy group, a sulfo group, a nitro group, a cyano group, etc.

The group $R_8$ represents an alkyl group having 1 to 18 carbon atoms (a methyl group, an ethyl group, a propyl group, a butyl group, an octyl group, a dodecyl group, an octadecyl group, etc.) or an aryl group (e.g. a phenyl group, a naphthyl group, etc.), preferably a phenyl group.

Examples of the heterocyclic group represented by $R_8$ may include thienyl, furyl, pyrrolyl, pyrazolyl, imidazolyl, pyridyl, pyrimidinyl, etc. As the substituent substitutable on these alkyl, aryl and heterocyclic groups, there can be included monovalent substituents which can be substituted on the above $R_7$.

X represents a carbonyl group, a sulfonyl group, a sulfoxy group, a phosphoryl group or a substituted or unsubstituted imino group (an imino group, an N-methylimino group, an N-phenylimino group, etc.), but preferably a carbonyl group.

Y represents a hydrogen atom, a hydroxyl group, a substituted or unsubstituted amino group (an amino group, a methylamino group, an anilino group, etc.), a carboxy group, a mercapto group, but preferably a hydrogen atom and a hydroxyl group.

The compound represented by the formula (2) preferably contains at least one of diffusion resistant group or silver halide adsorption promoting group.

As the diffusion resistant group, ballast groups conventionally used in the immobilizing additive for photography such as coupler, etc. are preferred. Ballast groups are relatively inert groups to photographic characteristic and having 8 or more carbon atoms, which can be selected from, for example, an alkyl group, an alkoxy group, a phenyl phenoxy group, etc.

As the silver halide adsorption promoting group, there may be included the groups as disclosed in U.S. Pat. No. 4,385,108 such as a thiourea group, a thiourethane group, a heterocyclic thioamide group, a mercapto heterocyclic group, a triazole group, etc.

The H in —NHNH— in the formula (2), namely the hydrogen atom of hydrazine may be substituted with a substituent such as a sulfonyl group (e.g. methanesulfonyl, toluenesulfonyl, etc.), an acyl group (e.g. aceetyl, trifluorocetyl, etc.), an oxalyl group (e.g. ethoxalyl, etc.), and the compounds represented by the formula (2) also include such compounds.

Representative compounds represented by the above formula (2) may include those as shown below. As a matter of course, the specific compounds of the formula (2) useful in the present invention are not limited to these compounds.

Exemplary compounds:

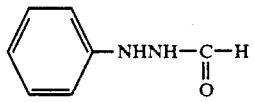

(2)-1

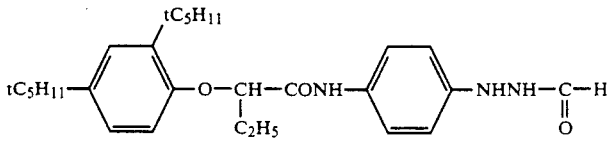

(2)-2

-continued
(2)-3
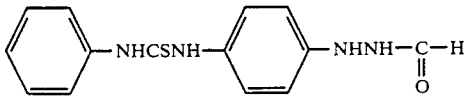
(2)-4
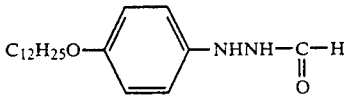
(2)-5
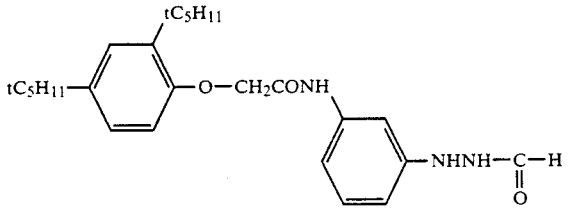
(2)-6
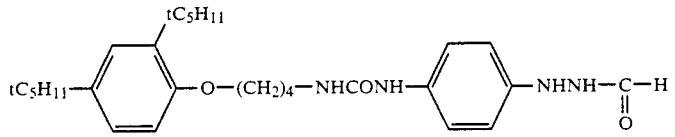
(2)-7
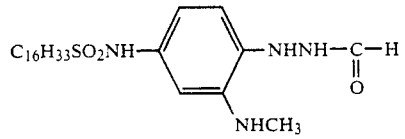
(2)-8
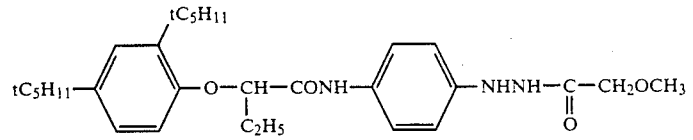
(2)-9
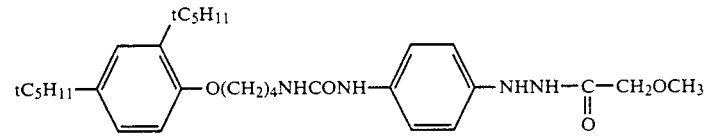
(2)-10
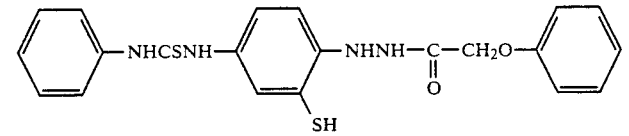
(2)-11
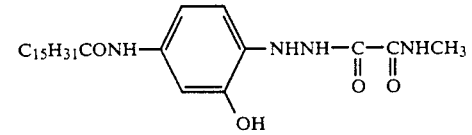
(2)-12
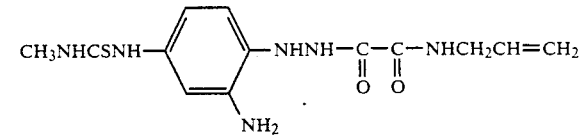

-continued
(2)-13
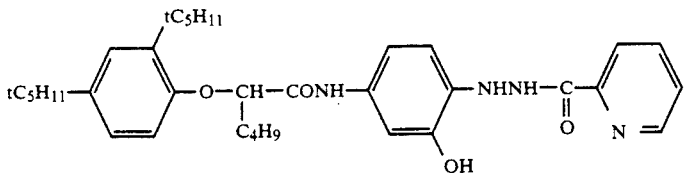
(2)-14
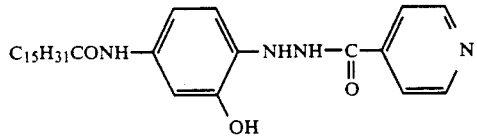
(2)-15
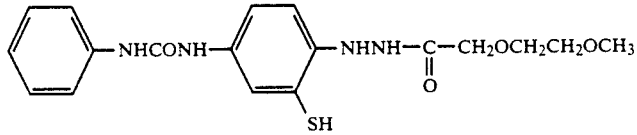
(2)-16
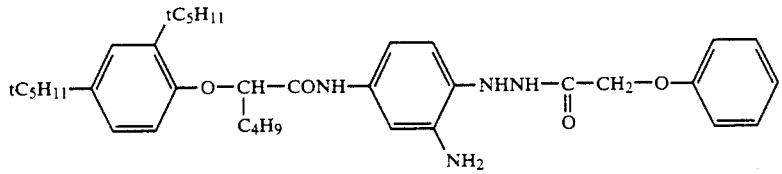
(2)-17
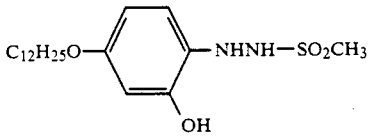
(2)-18
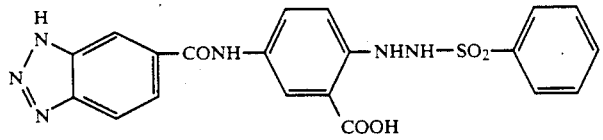
(2)-19
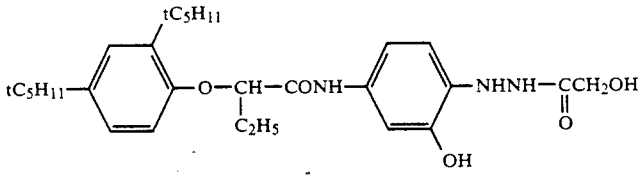
(2)-20
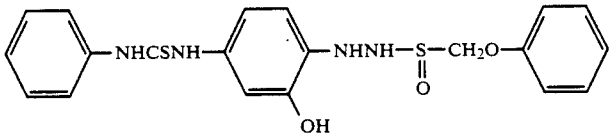
(2)-21
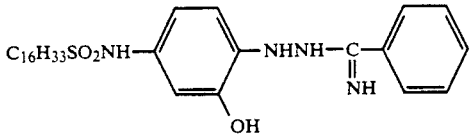
(2)-22
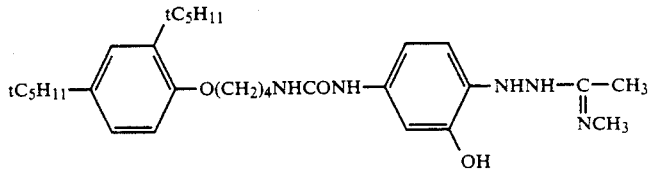

-continued
(2)-23
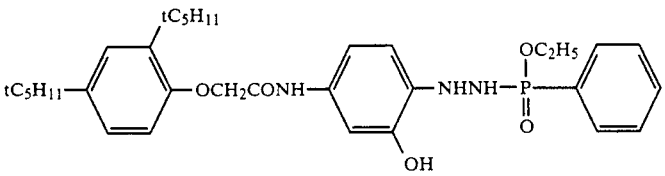
(2)-24
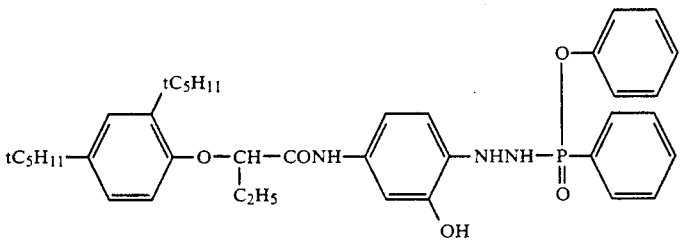
(2)-25
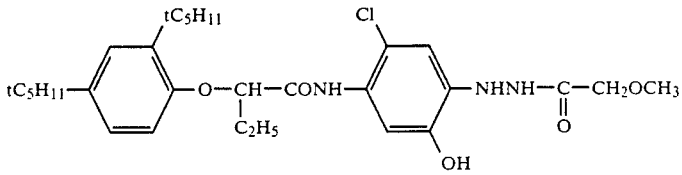
(2)-26
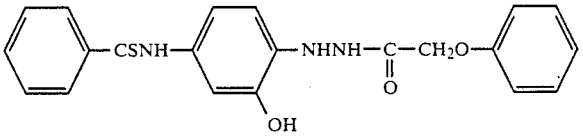
(2)-27
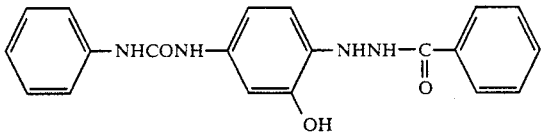
(2)-28
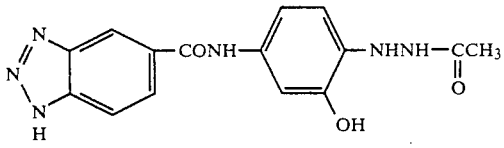
(2)-29
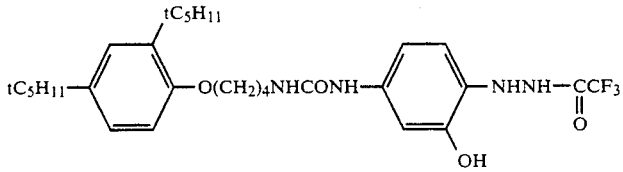
(2)-30
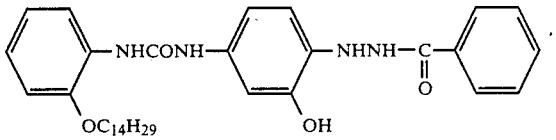
(2)-31
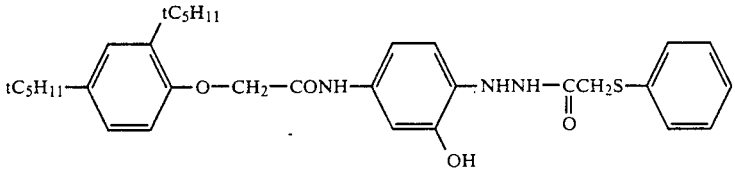

-continued (2)-32

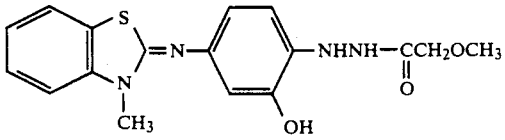

(2)-33

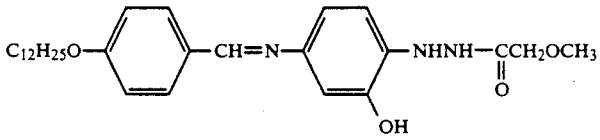

In the following, synthesis examples of the specific compounds of the present invention are described. Concerning the compound (2)-2, its synthesis scheme is as follows.

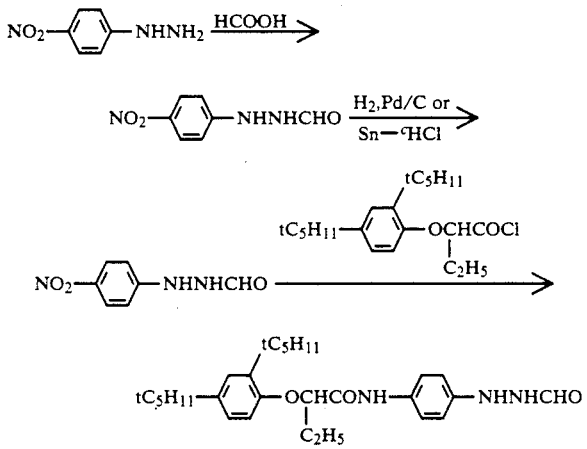

This synthetic method can be practiced by referring to, for example, the synthetic method of Japanese Provisional Patent Publication No. 52050/1980.

The starting material 2-hydrazino-5-nitrophenol can be synthesized according to, for example, the following synthetic scheme:

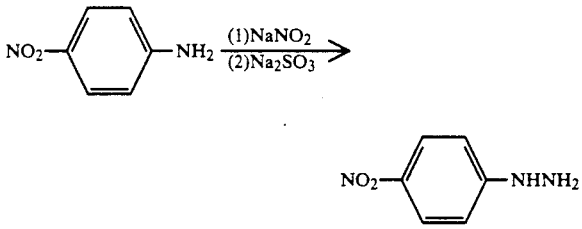

In the light-sensitive silver halide photographic material of the present invention, the compound represented by the above formula (2) is contained, and an amount of the compound of the formula (2) contained in the light-sensitive photographic material of the present invention may be preferably $5 \times 10^{-7}$ mole to $5 \times 10^{-1}$ mole per mole of silver halide contained in the light-sensitive photographic material of the present invention.

Particularly, it is preferred that the amount may be within the range of from $5 \times 10^{-5}$ mole to $1 \times 10^{-2}$ mole.

The silver halide to be used in the silver halide emulsion layer of the present invention may be either one of silver chloride, silver chlorobromide, silver chloroiodobromide, silver iodobromide.

The grain size of the silver halide is not particularly limited, but preferably an average grain size less than 0.5 μm, preferably the so-called monodispersed grains with 90 % or more of the total grain number falling within the range of ±40% of the average grain size as the center.

The crystal habit of the silver halide grains may be either cubic, tetradecahedral and octahedral, and may be also the tablet type grains as disclosed in Japanese Provisional Patent Publication No. 108525/1983.

The silver halide grains in the silver halide emulsion layer of the present invention can be prepared according to any of the single jet method such as the normal precipitating method, the reverse precipitating method, etc. or the double jet method according to the simultaneous precipitating method, more preferably the simultaneous precipitating method. Also, any of the ammonia method, the neutral method, the acidic method and the modified ammonia method as disclosed in Japanese Patent Publication No. 3232/1983 may be employed, more preferably the acidic method or the neutral method.

Also, within the silver halide grains, metal atoms such as iridium, rhodium, osmium, bismuth, cobalt, nickel, ruthenium, iron, copper, zinc, lead, cadmium, etc. may be also contained.

When these metal atoms are contained, they should be preferably contained in an amount within the range of $10^{-8}$ to $10^{-5}$ mole per mole of silver halide.

The silver halide emulsion of the silver halide emulsion layer according to the present invention (hereinafter called "the silver halide photographic emulsion of the present invention") can be applied with chemical sensitization. The chemical sensitization method may include sulfur sensitization, reduction sensitization and noble metal sensitization, but in the present invention, it is preferred to perform chemical sensitization by sulfur sensitization alone. As the sulfur sensitizer, other than sulfur compounds contained in gelatin, there can be employed various sulfur compounds such as thiosulfates, thioureas, thiazoles, rhodanines, etc., specifically sulfur sensitizers as described in U.S. Pat. Nos. 1,574,944, No. 2,410,689 and No. 2,728,668, and Japanese Patent Publication No. 11892/1984.

The silver halide photographic emulsion of the present invention can impart photosensitivities to the respective desired photosensitive wavelength regions. Here, optical sensitization may be also effected by use of one or more kinds of sensitizing dyes. Although various sensitizing dyes may be available, the optical sensitizing dyes which can be advantageously used in the present invention may include cyanines, carbocyanines, merocyanines, trinuclei or tetranuclei merocyanines, trinuclei or tetranuclei cyanines, styryls, holopolar cyanines, heminecyanines, oxonols, hemioxonols, etc., and these optical sensitizing dyes should preferably contain nucleus of a basic group such as thiazoline, thiazole, etc., or rhodanine, thiohydantoin, oxazolinedione, barbituric acid, thiobarbituric acid, pyrazolone, etc. as the nitrogen-containing heterocyclic nucleus as a part of its structure, and such nucleus can be substituted with alkyl, hydroxyalkyl halogen, phenyl, cyano, alkoxy, and also these optical sensitizing dyes may be fused with a carbon ring or a heterocyclic ring.

In the silver halide photographic emulsion of the present invention, it is possible to add a stabilizer such as tetrazaindenes; an antifoggant such as triazoles and tetrazoles; a covering power increasing agent; an antirradiation dye such as oxanol dyes, dialkylaminobenzilidene dyes, etc.; a humectant such as polymer latices; and other additives to be employed for emulsions for photography in general, such as extenders, hardeners, etc.

The support of the light-sensitive silver halide photographic material of the present invention may be one conventionally used such as polyester base, TAC base, baryta paper, laminated paper, glass plate, etc.

As the developer to be used in the light-sensitive silver halide photographic material of the present invention, any of developers and lith developers utilized in light-sensitive silver halide photographic materials in general can be used. As the developing agent of these developers, there may be included dihydroxybenzenes such as hydroquinone, chlorohydroquinone, catechol, etc.; 3-pyrazolidones such as 1-phenyl-3-pyrazolidone, 1-phenyl-4,4-dimethyl-3-pyrazolidone, 1-phenyl-4-methyl-3-pyrazolidone, 1-phenyl-4-methyl-4-hydroxymethyl-3-pyrazolidone; and further p-aminophenols such as N-methyl-p-aminophenol and N-(4-hydroxyphenyl)-glycine; p-phenylenediamines such as β-methanesulfonamide ester, ethylaminotoluidine and N,N-diethyl-p-phenylenediamine; and ascorbic acids, and it is used as an aqueous solution containing one or more of such developing agents.

Otherwise, the developer can be constituted by adding a preservative such as sodium sulfite, potassium sulfite, formaldehyde, sodium hydrogen sulfite, hydroxylamine and ethyleneurea; a development inhibitor of an inorganic salt such as sodium bromide, potassium bromide and potassium iodide; at least one organic inhibitor such as 1-phenyl-5-mercaptotetrazole, 5-nitrobenzimidazole, 5-nitrobenzotriazole, 5-nitroindazole, 5-methylbenzotriazole, 4-thiazoline-2-thione, etc.; an alkali agent such as sodium hydroxide, potassium hydroxide, etc.; alkanolamines having development accelerating effect such as diethanolamine, triethanolamine, 3-diethylamine-1-propanol, 2-methylamino-1-ethanol, 3-diethylamino-1,2-propanediol, diisopropylamine, 5-amino-1-pentanol, 6-amino-1-hexanol, etc.; a buffering agent having the buffering effect in the developer such as sodium carbonate, sodium phosphate, an aqueous carbonic acid solution, an aqueous phosphoric acid solution, etc.; salts such as sodium sulfate, sodium acetate, sodium citrate, etc.; a hard water softener by the chelation effect such as sodium ethylenediaminetetraacetate, sodium nitrilotriacetate, sodium hydroxydiaminetriacetate; a development hardener such as glutaraldehyde; a solvent for developing agent or organic inhibitor such as diethylene glycol, dimethylformaldehyde, ethyl alcohol and benzyl alcohol; a development controller such as methylimidazoline, methylimidazole, polyethylene glycol, dodecylpyridinium bromide, etc.

The pH of the developer is not particularly limited but may be preferably within the range of pH 9 to 13.

A preferred example of the developer constitution for developing the light-sensitive silver halide photographic material of the present invention is as follows. It is a developer prepared by adding 20 to 60 g/l of hydroquinone and 0.1 to 2 g/l of 1-phenyl-4-methyl-4-hydroxymethyl-3-pyrazonlidone or 0.1 to 2 g/l of 1-phenyl-4,4-dimethyl-3-pyrazolidone as the developing agents, 10 to 200 g/l of sodium sulfite or 10 to 200 g/l of potassium sulfite as the preservative for the developer, 1 to 10 g/l of sodium bromide or potassium bromide as the development inhibitor of an inorganic salt, 1 to 50 g/l of an alkanolamine having the development accelerating effect, 0.05 to 2 g/l of 5-methylbenzotriazole or 0.01 to 2 g/l of 5-nitroindazole as the organic inhibitor, 1 to 50 g/l of disodium carbonate or 10 to 800 ml/l (1 mole /1) of an aqueous phosphoric acid solution as the buffering agent, 0.1 to 10 g/l of disodium ethylenediaminetetraacetate as the chelating agent, and adjusting the pH to 11.0 to 12.5 by use of an appropriate alkali agent (e.g. potassium hydroxide).

The light-sensitive silver halide photographic material of the present invention is developed with a developer as described above, and then the image is fixed via the process of fixing, water washing and drying. The time required for the whole process as mentioned above should be desirably between 20 seconds and 60 seconds.

In the processing method of the present invention, preferred processing temperature and processing time of respective processing is as follows:

Developing processing is preferably carried out at a temperature of 30° to 45° C., more preferably 33° to 38° C., particularly preferably 34° to 36° C.

Preferred temperature ranges of fixing processing are the same as those of the developing processing. Also, preferred processing time of the fixing processing is 5 to 15 sec., more preferably 8 to 12 sec. in view of clearing property.

Washing processing is preferably carried out at a temperature of 20° to 45° C., more preferably 25° to 35° C., particularly preferably 28 to 32° C. Also, preferred processing time of the washing processing is 5 to 15 sec., more preferably 8 to 12 sec. in view of color residual.

Drying processing is preferably carried out at a temperature of 400° to 60° C., more preferably 45° to 55° C. Also, preferred processing time of the drying processing is 5 to 20 sec., more preferably 10 to 15 sec.

EXAMPLES

The present invention is described in more detail below by referring to the following Examples, by which the present invention is not limited at all.

EXAMPLE 1

Into an aqueous gelatin solution maintained at 40° C. were added an aqueous silver nitrate solution and an aqueous halide solution (KBr 40 mole %, NaCl 60 mole %) according to the simultaneous controlled double jet method over 60 minutes, while maintaining pAg at 7.7 and pH at 3.0, to prepare a monodispersed silver chlorobromide emulsion with an average grain size of 0.20 μm. The emulsion was desalted and washed with water in conventional manner, and then 15 mg of sodium thiosulfate was added per 1 mole of silver chlorobromide, followed by chemical ripening at 60° C. for 80 minutes.

Next, into the emulsion was added 1 g/1 mole silver of 6-methyl-4-hydroxy-1,3,3a,7-tetrazaindene. 250 mg/1 mole silver of the following compound (M) as the sensitizing dye, 300 mg/1 mole silver of a polyethylene glycol with a molecular weight of about 4000, 400 mg/1 mole silver of sodium sulfite and a hydrazine compound were added to $2\times10^{-5}$ mole/1 mole silver as shown in Table 1.

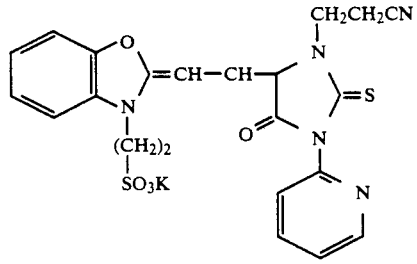

(M)

Into the emulsion thus obtained were added $1\times10^{-3}$ mole/1 mole silver of 5-nitroindazole and $5\times10^{-3}$ mole/1 mole silver of hydroquinone, a butyl acrylate latex polymer, and an aqueous saponin as the extender, and bis(vinylsulfonylmethyl) ether as the hardener to prepare an emulsion coating solution. Further, into an aqueous gelatin solution were added an aqueous sodium 1-decyl-2-(3-isopentyl) succinate-2-sulfonate solution as the extender, a methyl methacrylate polymer with an average particle size of 3.0 μm as the matting agent and bis(vinylsulfonylmethyl) ether as the film hardener to prepare a coating solution for protective film, which was then coated by simultaneous overlaying together with the above emulsion coating solution on a polyethylene terephthalate base, followed by drying. The silver densities for the respective samples are shown in Table 2. An amount of gelatin attached was 2.5 g/,$^2$, including the emulsion layer and the protective layer, an amount of the butyl acrylate latex attached was 1 g/m$^2$, an amount of matting agent attached was 30 mg/m$^2$, and an amount of the hardener including all of those added into the emulsion layer and the protective layer based on the total gelatin amount added was 2 g/100 g gelatin.

After stepwise exposure was given to the above samples 1 to 6 by a tungsten light source through a film wedge in conventional manner, developing was performed by use of the developer shown below, followed by fixing, washing and drying, and then sensitivity and contrast were evaluated.

The contrast is represented in slope of the linear portion of the characteristic curve (tan θ value).

The processing conditions are shown below.

| Step | Temperature (°C.) | Time (sec.) |
|---|---|---|
| Developing | 40 | 12 |
| Fixing | 40 | 8 |
| Washing | 30 | 8 |
| Drying | 50 | 12 |

(Dry to Dry time is 40 sec.)

Composition of developer

| | |
|---|---|
| Hydroquinone | 34 g |
| N-Methyl-p-aminophenol | 0.23 g |
| Disodium ethylenediaminetetraacetate | 1 g |
| 3-Diethylamino-1,2-propanediol | 15 g |
| 5-Methylbenztriazole | 0.4 g |
| Benzhydrol | 0.2 g |
| $Na_2SO_3$ | 76 g |
| NaBr | 3 g |
| NaCl | 1.3 g |
| 1 mole/liter phosphoric acid solution | 400 ml |

NaOH necessary for adjusting pH to 11.5 is added, and then the solution made up to one liter with water.

Fixing solution recipe (Composition A)

| | |
|---|---|
| Ammonium thiosulfate (72.5% W/V aqueous solution) | 240 ml |
| Sodium sulfite | 17 g |
| Sodium acetate.trihydrate | 6.5 g |
| Boric acid | 6 g |
| Sodium citrate.dihydrate | 2 g |

(Composition B)

| | |
|---|---|
| Pure water (deionized water) | 17 ml |
| Sulfuric acid (50% W/V aqueous solution) | 4.7 g |
| Aluminum sulfate (aqueous solution containing 8.1% W/V calculated on $Al_2O_3$) | 26.5 g |

During use of the fixing solution, the above compositions A and B were dissolved in 500 ml of water in this order, and the solution was made up to one liter before use. The pH of the fixing solution was adjusted to 6 with acetic acid.

The results are shown in Table 1.

As is apparent from the results in Table 1, it can be understood that the samples obtained according to the present invention have high sensitivity and high contrast. The sensitivity is represented in relative sensitivity.

TABLE 1

| | Sample | Silver density | Hydrazine | Sensitivity | Gamma |
|---|---|---|---|---|---|
| Comparative | 1 | 0.3 | — | 50 | 8 |
| Comparative | 2 | 0.3 | (1) - 6 | 100 | 10 |
| This invention | 3 | 0.6 | (1) - 6 | 120 | 17 |
| This invention | 4 | 0.6 | (2) - 2 | 125 | 18 |
| This invention | 5 | 0.8 | (2) - 9 | 130 | 17 |
| Comparative | 6 | 0.8 | — | 60 | 7 |

Silver density . . . g/cm$^3$

EXAMPLE 2

A silver chlorobromide emulsion with an average grain size of 0.10 μm (AgCl 98 mole %, AgBr 2 mole %) containing $1\text{-}^{-6}$ mole of rhodium per one mole of silver was prepared in conventional manner, desalted and washed with water, and then sensitized with sulfur, followed by addition of $4\times10^{-3}$ mole/1 mole silver of 4-methyl-6-hydroxy-1,3,3a,7-tetrazaindene. To the emulsion were added $4\times10^{-3}$ mole/1 mole silver of:

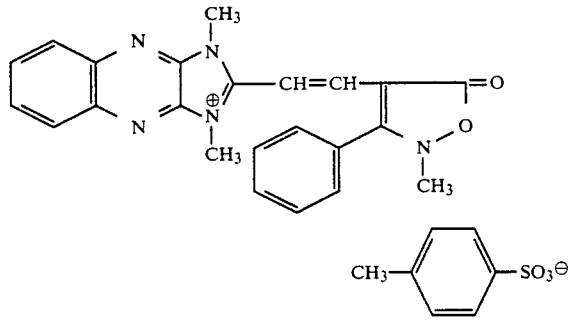

and further $5\times10^{-3}$ mole/1 mole silver of a filter dye Tartrazine having the main absorption at 400 to 500 nm and $6\times10^{-3}$ mole/1 mole silver of the following compound:

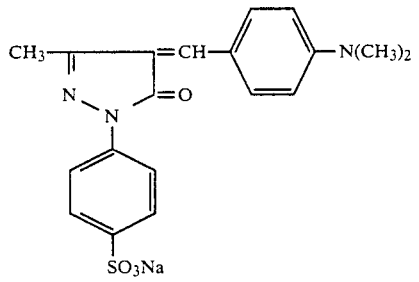

followed by addition of the hydrazine derivative to the amount of $3\times10^{-5}$ mole/1 mole silver as shown in Table 2. Further, 4×10—'mole/1 mole silver of 1-(p-acetylamidophenyl)-5-mercaptotetrazole and $2\times10^{-3}$ mole/1 mole silver of resorcinaldoxime as the antifoggant, $3\times10^{-4}$ mole/1 mole silver of nonylphenoxy polyethylene glycol (ethylene chain: n=30) as the development accelerator, and the latex polymer shown below, an aqueous saponin solution as the extender, and bis(vinylsulfomethyl)ether as the hardening agent were added to prepare an emulsion coating solution.

Further, into an aqueous gelatin solution were added an aqueous sodium n-dodecylbenzenesulfonate solution and an aqueous sodium fluorinated dodecylbenzenesulfonate solution as the extenders, a methyl methacrylate polymer with an average particle size of 3.0 μm as the matting agent, and bis(vinylsulfonylmethyl) ether as the film hardening agent to prepare a coating solution for protective layer, and coated together with the above emulsion coating solution by way of simulataneous overlaying and dried. The silver densities for respective samples at this time are shown in Table 2. An amount of gelatin attached was 2.5 g/m² including the emulsion layer and the protective layer, an amount of latex polymer attached was 1.5 g/m², an amount of the matting agent attached was 30 mg/m², and the hardening agent added was at a ratio of 4 g/100 g gelatin in both the emulsion layer and the protective layer.

Latex polymer

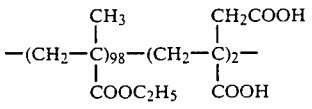

Weight average molecular weight: about 40,000

The samples obtained were exposed to a quartz iodine light source (halogen lamp) at 1.5 kW for 10 seconds. The discharging tube was a light source having a specific energy density at 400 nm or higher. The samples prepared here could be handled at lightness of 300 lux under fluorescent lamps in general. The development processing was applied similarly as in Example 1, and the results obtained are shown in Table 2. As is apparent from Table 2, it can be understood that the samples of the present invention have high sensitivity and high contrast.

TABLE 2

| | Sample No. | Silver density g/cm³ | Hydrazine | Sensitivity | Contrast |
|---|---|---|---|---|---|
| Comparative | 7 | 0.3 | — | 50 | 8 |
| Comparative | 8 | 0.3 | (1) - 6 | 100 | 11 |
| This invention | 9 | 0.6 | (1) - 6 | 120 | 16 |
| This invention | 10 | 0.6 | (2) - 6 | 140 | 18 |
| This invention | 11 | 0.8 | (2) - 9 | 125 | 17 |
| Comparative | 12 | 0.8 | — | 65 | 7 |

EXAMPLE 3

In the same manner as in Example 1 except for changing processing temperature and processing time as shown below, same experiment as in Example 1 was carried out. The results are shown in Table 3.

| Step | Temperature (°C.) | Time (sec.) |
|---|---|---|
| Developing | 35 | shown in Table 3 |
| Fixing | 34 | 10 |
| Washing | 30 | 10 |
| Drying | 50 | 12 |

TABLE 3

| | Sample | Silver density | Hydrazine | Sensitivity (Developing time) 20 | 15 | 10 | Gamma (Developing time) 20 | 15 | 10 |
|---|---|---|---|---|---|---|---|---|---|
| Comparative | 13 | 0.3 | — | 60 | 53 | 40 | 8 | 8 | 6 |
| Comparative | 14 | 0.3 | (1) - 6 | 105 | 102 | 80 | 10 | 10 | 7 |
| This invention | 15 | 0.6 | (1) - 6 | 125 | 122 | 115 | 10 | 15 | 16 |
| This invention | 16 | 0.6 | (2) - 2 | 130 | 125 | 115 | 9 | 17 | 17 |
| This invention | 17 | 0.8 | (2) - 9 | 135 | 130 | 120 | 9 | 16 | 15 |
| Comparative | 18 | 0.8 | — | 70 | 60 | 50 | 8 | 7 | 7 |

Silver density . . . g/cm³

EXAMPLE 4

In the same manner as in Example 2 except for changing processing temperature and processing time as shown below, same experiment as in Example 2 was carried out. The results are shown in Table 4.

| Step | Temperature (°C.) | Time (sec.) |
|---|---|---|
| Developing | 35 | shown in Table 4 |
| Fixing | 34 | 10 |
| Washing | 30 | 10 |
| Drying | 50 | 12 |

TABLE 4

| | Sample No. | Silver density g/cm³ | Hydrazine derivative | Sensitivity (Developing time 20) | Sensitivity (Developing time 15) | Sensitivity (Developing time 10) | Contrast (Developing time 20) | Contrast (Developing time 15) | Contrast (Developing time 10) |
|---|---|---|---|---|---|---|---|---|---|
| Comparative | 19 | 0.3 | — | 65 | 60 | 50 | 8 | 8 | 6 |
| Comparative | 20 | 0.3 | (1) - 6 | 105 | 102 | 90 | 11 | 11 | 10 |
| This invention | 21 | 0.6 | (1) - 6 | 125 | 122 | 110 | 11 | 16 | 16 |
| This invention | 22 | 0.6 | (2) - 6 | 145 | 140 | 130 | 7 | 18 | 18 |
| This invention | 23 | 0.8 | (2) - 9 | 130 | 125 | 120 | 10 | 16 | 15 |
| Comparative | 24 | 0.8 | — | 70 | 65 | 50 | 7 | 7 | 7 |

According to the present invention, a light-sensitive silver halide photographic material and processing method could be provided with high sensitivity and high contrast even by rapid processing.

We claim:

1. A method for forming an image comprising inmagewise exposing, developing and fixing a negative type light-sensitive silver halide photographic material having at least one light-sensitive silver halide emulsion layer on a support, wherein the silver density on the emulsion layer side of said light-sensitive silver halide photographic material is 0.5 g/cm³ or higher and wherein said silver halide emulsion layer contains a hydrazine derivative, said hydrazine derivative comprising a compound represented by the formula (1):

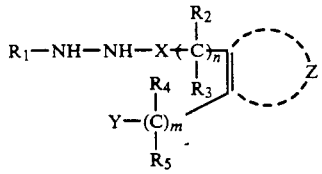

(1)

wherein $R_1$ represents a heterocyclic residue having at least one of an oxygen atom, a nitrogen atom or a sulfur atom; $R_2$ to $R_5$ each represent a hydrogen atom, an alkyl group having 1 to 18 carbon atoms or an aryl group; n and m each represent 0 to 1; X represents a carbonyl group, a sulfonyl group, a sulfoxy group,

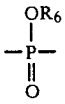

($R_6$ represents the same meaning as $R_2$ to $R_5$), or an imino group; Y represents a hydroxyl group, an amino group, a carboxyl group, or a mercapto group; Z represents atoms necessary for forming a 5- to 6-membered ring, wherein said silver halide photographic material is processed within a developing time of 15 seconds.

2. A method for forming an image according to claim 1, wherein said hydrazine derivative is contained in an amount of $5\times10^{-7}$ mole to $5\times10^{-1}$ mole per mole of silver halide contained in the light-sensitive photographic material.

3. A method for forming an image according to claim 2, wherein said hydrazine derivative is contained in an amount of $5\times10^{-5}$ mole to $1\times10^{-2}$ mole.

4. A method for forming an image according to claim 1, wherein $R_1$ in the formula (1) is thienyl, furyl, pyrrolyl, pyrazolyl, imidazolyl, pyridyl, pyrimidinyl, pyrazinyl, benzothienyl, benzofuranyl, indolyl, indazolyl, benzoxazolyl, oxazolyl, or thiazolyl group.

5. A method for forming an image according to claim 2, wherein each of $R_2$ to $R_5$ in the formula (1) represents a hydrogen atom, a methyl group, an ethyl group, a propyl group, a butyl group, an octyl group, a dodecyl group, an octadecyl group or a phenyl group.

6. A method for forming an image according to claim 1, wherein X in the formula (1) represents a carbonyl group, a sulfonyl group, a sulfoxy group,

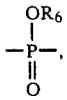

an unsubstituted imino group, an N-methylimino group or an N-phenylimino group.

7. A method for forming an image according to claim 1, wherein Y in the formula (1) represents a hydroxyl group, an unsubstituted amino group, a methylamino group, an anilino group, acarboxy group or a mercapto group.

8. A method for forming an image according to claim 1, wherein a formed ring of Z in the formula (1) is benzene, cyclohexene or cyclopentene.

* * * * *

UNITED STATES PATENT AND TRADEMARK OFFICE

CERTIFICATE OF CORRECTION

PATENT NO. : 5,030,546

DATED : July 09, 1991

INVENTOR(S) : Yasuhiko Takamuki et al.

It is certified that error appears in the above-identified patent and that said Letters Patent is hereby corrected as shown below:

Abstract, line 3, change "be" to --by--.

Claim 1, column 29, lines 31 and 32 change "inmagewise" to --imagewise--.

Claim 5, column 30, line 29, change "2" to --1--.

Claim 7, column 30, line 48, change "acarboxy" to --a carboxy--.

Signed and Sealed this

Sixteenth Day of March, 1993

*Attest:*

STEPHEN G. KUNIN

*Attesting Officer*

*Acting Commissioner of Patents and Trademarks*